US006669577B1

(12) United States Patent
Hocknell et al.

(10) Patent No.: US 6,669,577 B1
(45) Date of Patent: Dec. 30, 2003

(54) GOLF CLUB HEAD WITH A FACE INSERT

(75) Inventors: Alan Hocknell, Encinitas, CA (US); Evan D. Gibbs, Carlsbad, CA (US); Richard C. Helmstetter, Rancho Santa Fe, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 10/064,135

(22) Filed: Jun. 13, 2002

(51) Int. Cl.[7] ..... A63B 53/04

(52) U.S. Cl. ..... 473/329; 473/342; 473/345; 473/349

(58) Field of Search ..... 473/324, 345, 473/346, 349, 350, 329, 290, 291, 292, 342

(56) References Cited

U.S. PATENT DOCUMENTS

| | | | | | |
|---|---|---|---|---|---|
| 4,429,879 | A | * | 2/1984 | Schmidt | 473/346 |
| 4,432,549 | A | * | 2/1984 | Zebelean | 473/346 |
| 5,042,806 | A | | 8/1991 | Helmstetter et al. | |
| 5,094,383 | A | * | 3/1992 | Anderson et al. | 228/176 |
| 5,261,663 | A | * | 11/1993 | Anderson | 473/342 |
| 5,288,344 | A | | 2/1994 | Peker et al. | |
| 5,294,037 | A | * | 3/1994 | Schmidt | 228/125 |
| 5,318,300 | A | | 6/1994 | Schmidt et al. | |
| 5,346,217 | A | * | 9/1994 | Tsuchiya et al. | 473/345 |
| 5,735,975 | A | | 4/1998 | Lin et al. | |
| 5,766,094 | A | * | 6/1998 | Mahaffey et al. | 473/342 |
| 5,954,594 | A | * | 9/1999 | Uchiyama et al. | 473/290 |
| 5,954,596 | A | * | 9/1999 | Noble et al. | 473/346 |
| 6,165,081 | A | * | 12/2000 | Chou | 473/329 |
| 6,338,683 | B1 | | 1/2002 | Kosmatka | |
| 6,348,013 | B1 | * | 2/2002 | Kosmatka | 473/329 |
| 6,354,962 | B1 | | 3/2002 | Galloway et al. | |
| 6,364,789 | B1 | | 4/2002 | Kosmatka | |
| 6,368,234 | B1 | | 4/2002 | Galloway | |
| 6,471,603 | B1 | | 10/2002 | Kosmatka | |
| 2002/0006836 | A1 | | 1/2002 | Helmstetter et al. | |

* cited by examiner

*Primary Examiner*—Sebastiano Passaniti
(74) *Attorney, Agent, or Firm*—Michael A. Catania; Elaine H. Lo

(57) ABSTRACT

A golf club head (20) having a body (22) with a front wall (30) with an opening (32) and a striking plate insert (40) is disclosed herein. The front wall (30) has a perimeter region (50) encompassing the opening (32), which has a thickness less than the thickness of the striking plate insert (40). The golf club head (20) has a volume between 200 cubic centimeters and 600 cubic centimeters. The golf club head (20) has a mass between 140 grams and 215 grams.

2 Claims, 5 Drawing Sheets

GOLF CLUB HEAD WITH A FACE INSERT

CROSS REFERENCE TO RELATED APPLICATIONS

Not Applicable

FEDERAL RESEARCH STATEMENT

Not Applicable

BACKGROUND OF INVENTION

1. Field of the Invention

The present invention relates to a golf club head. More specifically, the present invention relates to a golf club head with a face insert.

2. Description of the Related Art

High performance drivers employ relatively thin, high strength face materials. These faces are either formed into the curved face shape then welded into a driver body component around the face perimeter, or forged into a cup shape and connected to a body by either welding or adhesive bonding at a distance offset from the face of up to 0.75 inch. The faces formed from sheet material have an advantage in slightly superior material properties over cup-shape faces forged from round bar, and noticeably lower production costs.

However, in the formed sheet approach, the position of the weld and the structural characteristics of the surrounding body component have greater bearing on the stiffness of the face than with cup-shape faces. The stiffness of the face affects both the performance of the face-in terms of golf ball rebound speed and the durability of the face under repeated impact loading.

In a popular embodiment of the sheet-formed face insert driver, the weld between the formed face insert and the investment cast driver body is located on the striking face, a small distance from the face perimeter.

It is common practice for the face insert to be of uniform thickness and to design the surrounding driver body component to be of equal thickness. In this way there is continuity of face thickness across the weld.

Several patents discloses face inserts. Anderson, U.S. Pat. Nos. 5,624,437, 5,094,383, 5,255,918, 5,261,663 and 5,261,664 disclose a golf club head having a full body composed of a cast metal material and a face insert composed of a hot forged metal material.

Viste, U.S. Pat. No. 5,282,624 discloses a golf club head with a cast metal body and a forged steel face insert with grooves on the exterior surface and the interior surface of the face insert and having a thickness of 3 mm.

Rogers, U.S. Pat. No. 3,970,236, discloses an iron club head with a formed metal face plate insert fusion bonded to a cast iron body.

Galloway, et alii, U.S. Pat. No. 6,354,962 discloses a golf club head of a face cup design.

However, none of the prior art patents disclose a means for achieving material properties and cost savings of the face inserts with the performance properties of the face-cup design.

SUMMARY OF INVENTION

The present invention overcomes the problems of the prior art by providing a golf club head that has a body with a striking plate insert in which the body has a front wall perimeter region that is thinner than the striking plate insert. This allows the golf club head of the present invention to have similar performance to a golf club head with a face cup design while having the material properties and cost savings of a golf club head with a face insert.

Having briefly described the present invention, the above and further objects, features and advantages thereof will be recognized by those skilled in the pertinent art from the following detailed description of the invention when taken in conjunction with the accompanying drawings.

DETAILED DESCRIPTION

Figure 1:
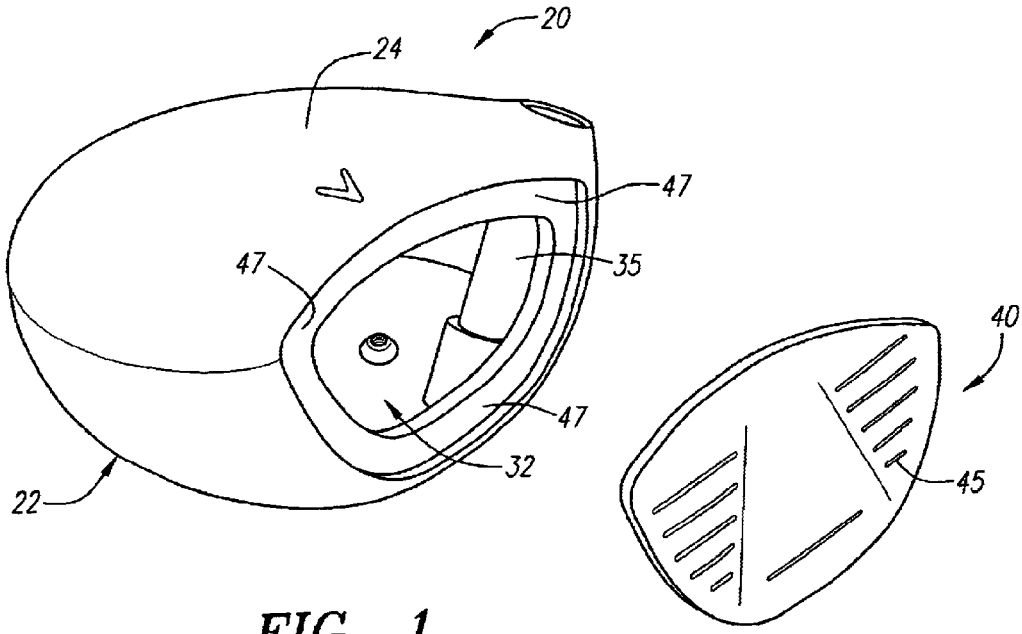
FIG. 1 is an exploded view of the components of a preferred embodiment of the golf club head of the present invention.
Figure 2:
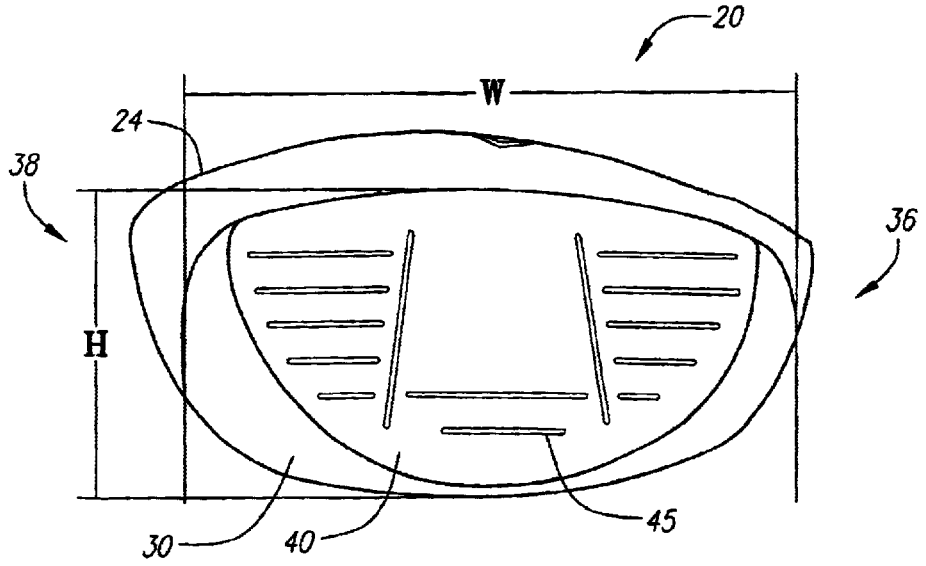
FIG. 2 is a front view of a golf club head of the present invention.
Figure 3:
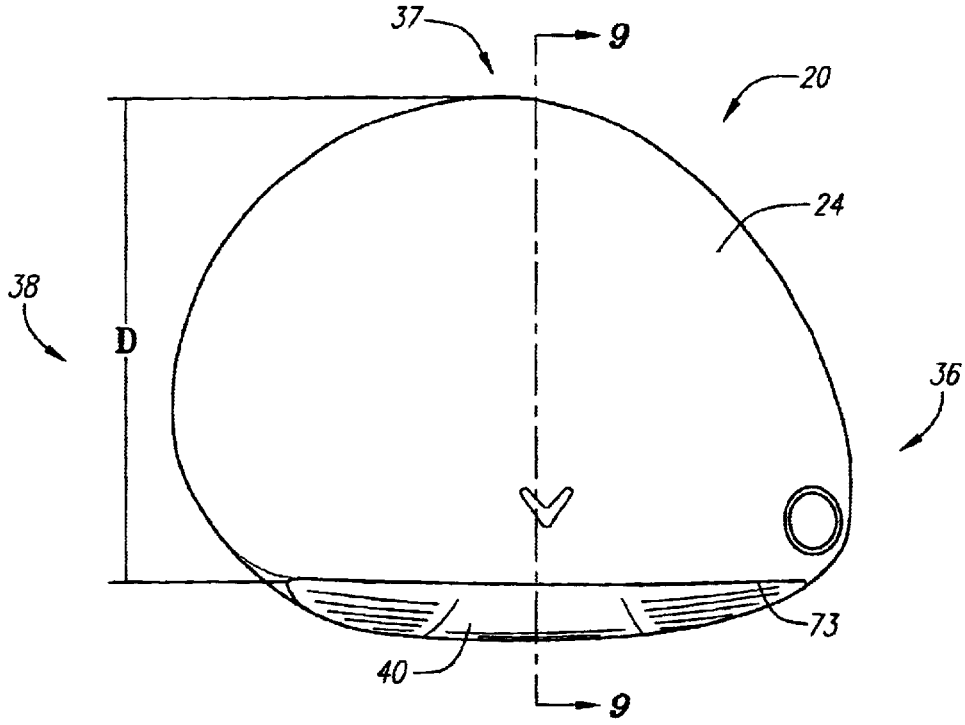
FIG. 3 is a top plan view of a golf club head of the present invention.
Figure 4:
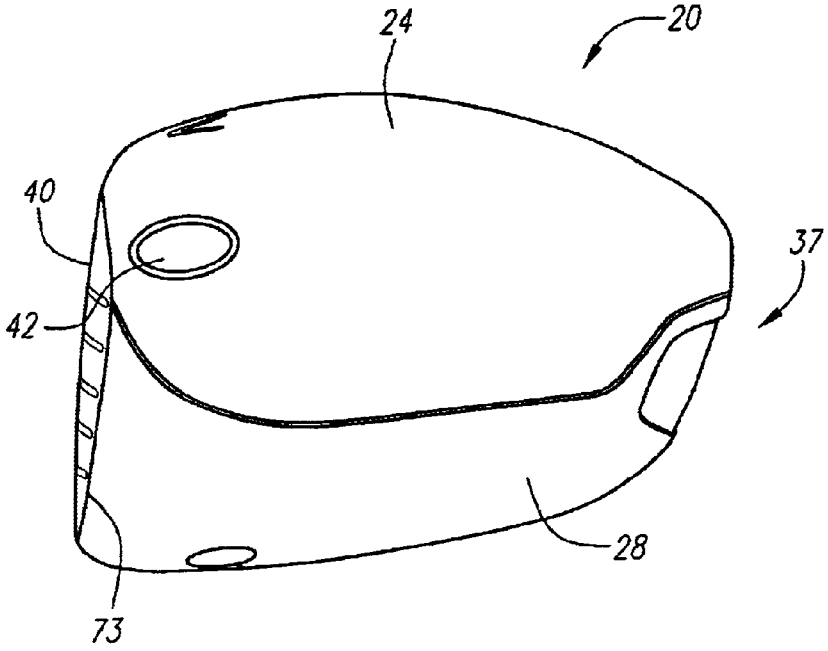
FIG. 4 is a side view of the heel end of a golf club head of the present invention.
Figure 5:
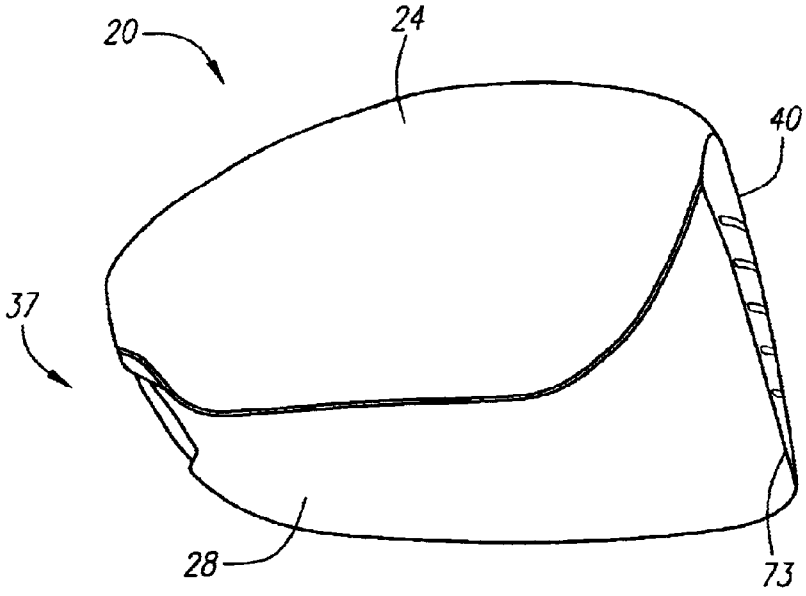
FIG. 5 is side view of the toe end of a golf club head of the present invention.
Figure 6:
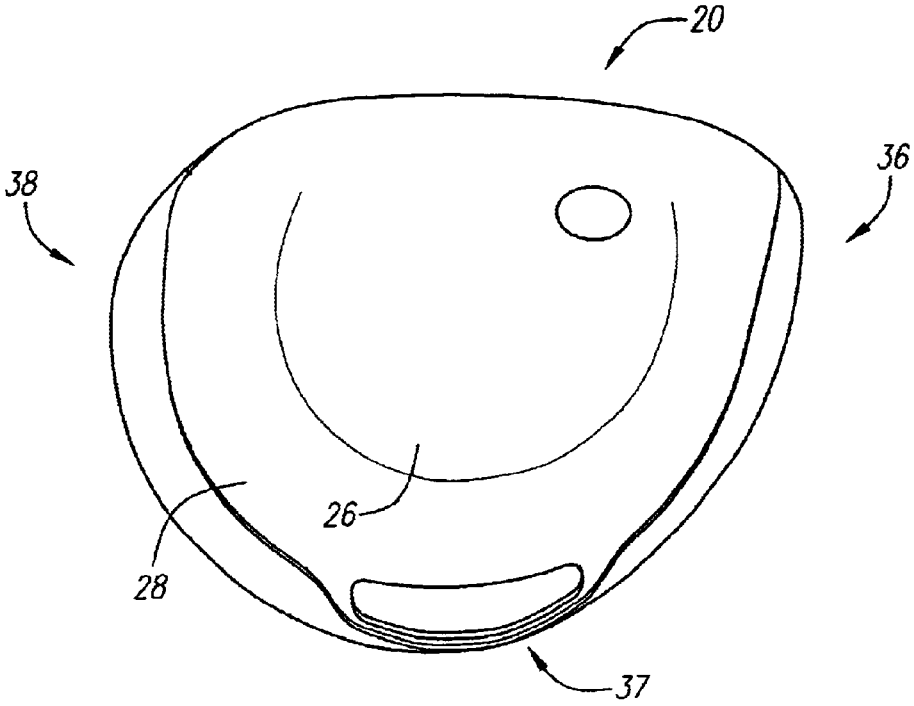
FIG. 6 is a bottom plan view of a golf club head of the present invention.
Figure 7:
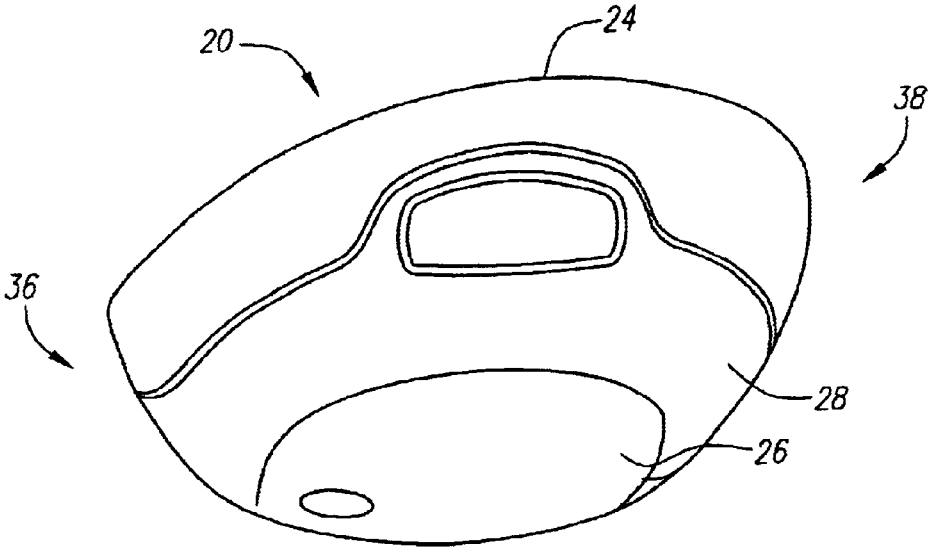
FIG. 7 is a rear view of a golf club head of the present invention.
Figure 8:
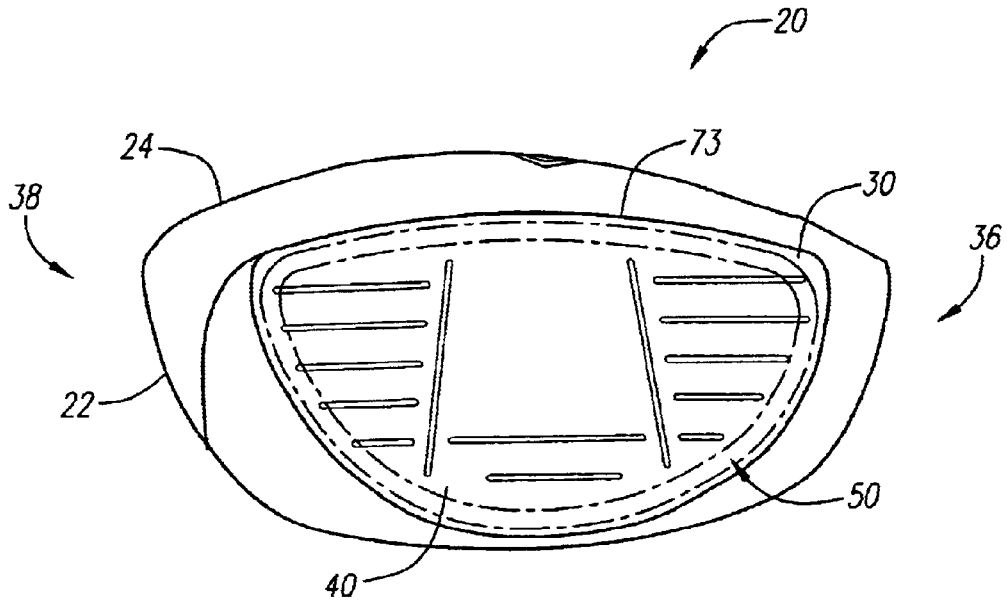
FIG. 8 a front view of a golf club head of the present invention showing the perimeter region in dashed lines.
Figure 9:
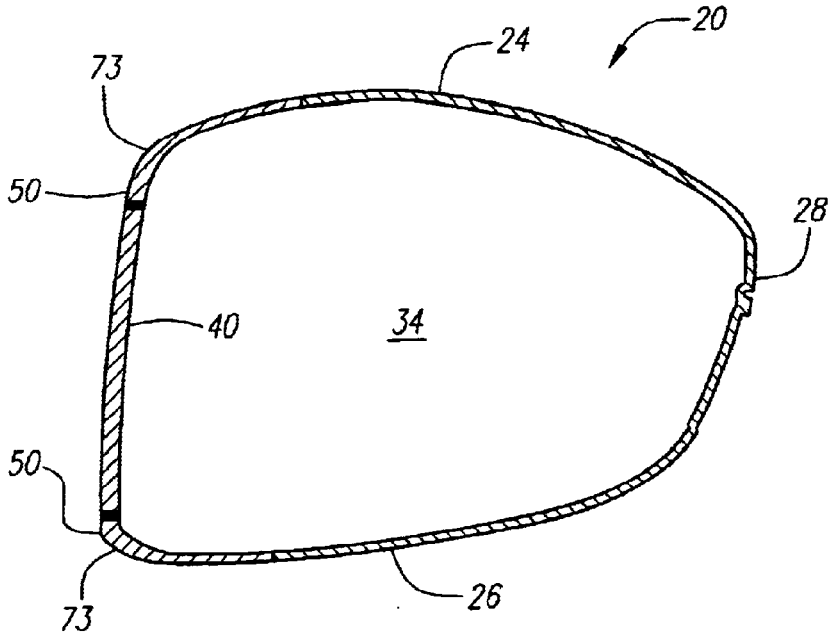
FIG. 9 is a cross-sectional view along line 9—9 of FIG. 3.

As shown in FIGS. 1–8, the golf club head of the present invention is generally designated 20. The golf club head 20 of FIGS. 1–8 is a driver; however, the golf club head of the present invention may alternatively be a fairway wood. The golf club head 20 has a body 22 that is preferably composed of a metal material such as titanium, titanium alloy, stainless steel, or the like, and is most preferably composed of a cast titanium alloy material. The body 22 is preferably cast from molten metal in a method such as the well-known lost-wax casting method. The metal for casting is preferably titanium or a titanium alloy such as 6–4 titanium alloy, alpha-beta titanium alloy or beta titanium alloy for forging, and 6–4 titanium for casting. Alternatively, the body 22 is composed of 17–4 steel alloy. Additional methods for manufacturing the body 22 include forming the body 22 from a flat sheet of metal, super-plastic forming the body 22 from a flat sheet of metal, machining the body 22 from a solid block of metal, electrochemical milling the body from a forged pre-form, and like manufacturing methods.

The golf club head 20, when designed as a driver preferably has a volume from 200 cubic centimeters to 600 cubic centimeters, more preferably from 300 cubic centimeters to 450 cubic centimeters, and most preferably from 350 cubic centimeters to 420 cubic centimeters. A golf club head 20 for a driver with a body 22 composed of a cast titanium alloy most preferably has a volume of 380 cubic centimeters. Alternatively, when the golf club head 20 is designed as a driver with a body 22 composed of stainless steel, the golf club head preferably has a volume of 275 cubic centimeters. The volume of the golf club head 20 will also vary between fairway woods (preferably ranging from 3-woods to eleven woods) with smaller volumes than between drivers.

The golf club head 20, when designed as a driver preferably has a mass no more than 215 grams, and most preferably a mass of 180 to 215 grams. When the golf club head 20 is designed as a fairway wood, the golf club head preferably has a mass of 135 grams to 180 grams, and preferably from 140 grams to 165 grams.

The body 22 has a crown 24, a sole 26, a ribbon 28, and a front wall 30 with an opening 32. The body 22 preferably has a hollow interior 34. The golf club head 20 has a heel end 36, a toe end 38 an aft end 37. A shaft, not shown, is placed within a hosel, not shown, at the heel end 36. In a preferred embodiment, the hosel is internal to the body 22, and the shaft extends to the sole 30.

The golf club head also has striking plate insert 40 that is attached to the body 22 over the opening 32 of the front wall 30. The striking plate insert 40 preferably is composed of a formed titanium or steel material. Such titanium materials include pure titanium and titanium alloys such as 6–4 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. Other metals for the striking plate insert 40 include high strength steel alloy metals and amorphous metals. Such steel materials include 17-4PH, Custom 450, 455,465 and 465+ stainless steels, AERMET 100 and AERMET 310 alloy steels, all available from Carpenter Specialty Alloys, of Pennsylvania, and C35 maraging steels available from Allvac of North Carolina. Such amorphous metals include beryllium based alloys such as disclosed in U.S. Pat. No. 5,288,344, which pertinent parts are hereby incorporated by reference, quinary metallic glass alloys such as disclosed in U.S. Pat. No. 5,735,975, which pertinent parts are hereby incorporated by reference, and ternary alloys as disclosed in *Calculations of Amorphous-Forming Composition Range For Ternary Alloy Stems And Analyses Of Stabilization Of Amorphous Phase And Amorphous-Forming Ability, Takeuchi and Inoue,* Materials Transactions, Vol. 42, No. 7, p 1435–1444 (2001), which pertinent parts are hereby incorporated by reference. A striking plate insert 40 composed of an amorphous metal is attached through electron beam welding, brazing or press-fitted for attachment to the body 22. As shown in FIG. 1, the striking plate insert 40 typically has a plurality of scorelines 45 thereon.

As shown in FIG. 1, the striking plate insert 40 is welded to the front wall 30 of the body 22, thereby covering the opening 32. A plurality of tabs 47, preferably three, align the striking plate insert 40 for the welding process. Alternatively, the striking plate insert 40 is press-fitted into the opening 32.

In a preferred embodiment, the striking plate insert 40 has uniform thickness that ranges from 0.040 inch to 0.250 inch, more preferably a thickness of 0.080 inch to 0.120 inch, and is most preferably 0.108 inch for a titanium alloy striking plate insert 40 and 0.085 inch for a stainless steel striking plate insert 40.

The present invention is directed at a golf club head that has a high coefficient of restitution thereby enabling for greater distance of a golf ball hit with the golf club head of the present invention. The coefficient of restitution (also referred to herein as COR) is determined by the following equation:

$$E=(V_2-V_1)/(U_1-U_2)$$

wherein $U_1$ is the club head velocity prior to impact; $U_2$ is the golf ball velocity prior to impact which is zero; $V_1$ is the club head velocity just after separation of the golf ball from the face of the club head; $V_2$ is the golf ball velocity just after separation of the golf ball from the face of the club head; and E is the coefficient of restitution between the golf ball and the club face.

The values of E are limited between zero and 1.0 for systems with no energy addition. The coefficient of restitution, E, for a material such as a soft clay or putty would be near zero, while for a perfectly elastic material, where no energy is lost as a result of deformation, the value of E would be 1.0. The present invention provides a club head 20 preferably having a coefficient of restitution ranging from 0.81 to 0.94, as measured under conventional test conditions. The coefficient of restitution of the club head 20 of the present invention under standard USGA test conditions with a given ball preferably ranges from approximately 0.80 to 0.94, more preferably ranges from 0.82 to 0.89 and most preferably 0.843.

The depth of the club head 20 from the striking plate insert 40 to the aft-end 37 preferably ranges from 3.0 inches to 4.5 inches, and is most preferably 3.75 inches.

The height, H, of the club head 20, as measured while in address position, preferably ranges from 2.0 inches to 3.5 inches, and is most preferably 2.50 inches or 2.9 inches. The width, W, of the club head 20 from the toe end 38 to the heel end 36 preferably ranges from 4.0 inches to 5.0 inches, and more preferably 4.7 inches.

The front wall 30 has a perimeter region 50 encompassing the opening 32. The perimeter region extends from the opening 32 to the perimeter 73 of the front wall 30. The perimeter 73 of the front wall 30 is defined as the transition point where the front wall 30 transitions from a plane substantially parallel to the striking plate insert 40 to a plane substantially perpendicular to the striking plate insert 40. Alternatively, one method for determining the transition point is to take a plane parallel to the striking plate insert 40 and a plane perpendicular to the striking plate insert 40, and then take a plane at an angle of forty-five degrees to the parallel plane and the perpendicular plane. Where the forty-five degrees plane contacts the front wall 30 is the transition point thereby defining the perimeter of the front wall 30.

The perimeter region 50 has a reduced thickness in order to provide a stepped thickness for the impact portion of the golf club head 20, including the striking plate insert 40. The perimeter region 50 preferably has a uniform thickness that ranges from 0.040 inch to 0.190 inch, more preferably a thickness of 0.070 inch to 0.0110 inch, and most preferably a thickness of 0.090 inch to 0.105 inch. Alternatively, the perimeter region 50 has a thickness that varies with the thinnest portions away from the striking plate insert 40. However, the thickness of the perimeter region 50 is always less than the thickness of the striking plate insert 40. In a preferred embodiment, the thickness of the perimeter region is 0.098 inch.

TABLE ONE

| Driver | Thickness | COR | Durability Hits to Failure |
|---|---|---|---|
| Invention | Insert = .108"<br>Perimeter Region = .098" | 0.843 | 2500 |
| Standard (i) | Insert = .108"<br>Perimeter Region = .108" | 0.828 | 3000 |

TABLE ONE-continued

| Driver | Thickness | COR | Durability Hits to Failure |
|---|---|---|---|
| Standard (ii) | Insert = .096"<br>Perimeter Region = .096" | 0.843 | 1800 |

Table One illustrates the novelty of the present invention as compared to the prior art. The prior art golf club heads are referenced as Standard (i) and Standard (ii) in Table One. The golf club head 20 of the present invention is referenced as Invention. The prior art club heads have equal thickness from the insert and the perimeter region whereas the golf club head 20 of the present invention has a perimeter region 50 that is thinner than the striking plate insert 40. Thus, the golf club head 20 of the present invention can achieve a higher COR than a golf club head of the prior art with the same insert thickness. Further, the golf club head 20 of the present invention has greater durability than a golf club head of the prior art with a similar perimeter region thickness.

The center of gravity and the moments of inertia of the golf club head 20 may be calculated as disclosed in co-pending U.S. patent application Ser. No. 09/796,951, filed on Feb. 27, 200, now U.S. Pat. No. 6,607,452 entitled High Moment Of Inertia Composite Golf Club, and hereby incorporated by reference in its entirety. In general, the moment of inertia, Izz, about the Z axis for the golf club head 20 will preferably range from 2700 g-cm$^2$ to 4000 g-cm$^2$, more preferably from 3000 g-cm$^2$ to 3800 g-cm $^2$. The moment of inertia, Iyy, about the Y axis for the golf club head 20 will preferably range from 1500 g-cm$^2$ to 3500 g-cm$^2$.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A wood-type golf club head comprising:

a body having a crown, a sole, a ribbon, and a front wall with an opening, the front wall having a perimeter region encompassing the opening, the perimeter region having a thickness of 0.070 inch to 0.0110 inch, the perimeter region extending from the opening to the perimeter of the front wall, the body composed of a cast titanium alloy material; and a striking plate insert positioned within the opening, the striking plate insert having a uniform thickness in the range of 0.080 inch to 0.120 inch, the striking plate insert composed of a formed titanium alloy material;

wherein the perimeter region has a thickness less than the thickness of the striking plate insert, the golf club head has a volume ranging from 350 cubic centimeters to 420 cubic centimeters and a mass ranging from 185 grams to 215 grams, and the golf club head has a coefficient of restitution ranging from 0.82 to 0.89;

wherein the depth of the golf club head from the aft end to the striking plate insert ranges from 3.0 inches to 4.5 inches, the height of the golf club head from the sole to the crown ranges from 2.0 inches to 3.5 inches, and the width of the golf club head from the toe end to the heel end ranges 4.0 inches to 5.0 inches.

2. A wood-type golf club head comprising:

a body having a crown, a sole, a ribbon, and a front wall with an opening, the front wall having a perimeter region encompassing the opening, the perimeter region having a thickness of 0.070 inch to 0.0110 inch, the perimeter region extending from the opening to the perimeter of the front wall, the crown having a thickness of 0.030 inch to 0.050 inch, the sole having a thickness of 0.030 inch to 0.050 inch, the body composed of a cast titanium alloy material; and a striking plate insert positioned within the opening and welded to the body, the striking plate insert having a uniform thickness in the range of 0.080 inch to 0.120 inch, the striking plate insert composed of a formed titanium alloy material;

wherein the perimeter region has a thickness less than the thickness of the striking plate insert, the golf club head has a volume ranging from 350 cubic centimeters to 420 cubic centimeters and a mass ranging from 185 grams to 215 grams, and the golf club head has a coefficient of restitution ranging from 0.82 to 0.89;

wherein the depth of the golf club head from the aft end to the striking plate insert ranges from 3.0 inches to 4.5 inches, the height of the golf club head from the sole to the crown ranges from 2.0 inches to 3.5 inches, and the width of the golf club head from the toe end to the heel end ranges 4.0 inches to 5.0 inches.

* * * * *